US008555435B1

(12) United States Patent
Schiller et al.

(10) Patent No.: US 8,555,435 B1
(45) Date of Patent: Oct. 15, 2013

(54) BOX SPRING SUPPORT FOR MATTRESSES

(71) Applicants: Stephen J. Schiller, Naples, FL (US); Lucien Sammartano, Jupiter, FL (US)

(72) Inventors: Stephen J. Schiller, Naples, FL (US); Lucien Sammartano, Jupiter, FL (US)

(73) Assignee: Pranasleep, LLC, Bonita Springs, FL (US)

( * ) Notice: Subject to any disclaimer, the term of this patent is extended or adjusted under 35 U.S.C. 154(b) by 0 days.

(21) Appl. No.: 13/760,773

(22) Filed: Feb. 6, 2013

(51) Int. Cl.
*A47C 23/05* (2006.01)
*A47C 23/053* (2006.01)
*F16F 3/00* (2006.01)

(52) U.S. Cl.
USPC ..... 5/263; 5/230; 5/402; 267/100

(58) Field of Classification Search
USPC ..... 5/263, 230, 235, 248, 402; 267/99, 100
See application file for complete search history.

(56) References Cited

U.S. PATENT DOCUMENTS 22,742 A * 1/1859 Monroe ..... 5/262
681,124 A * 8/1901 Lally ..... 5/230
897,541 A * 9/1908 Kilburn et al. ..... 5/409
901,516 A * 10/1908 Billow ..... 5/248
1,257,335 A * 2/1918 Flint ..... 5/409
2,109,282 A * 2/1938 Bernstein ..... 267/99
2,265,532 A * 12/1941 Levine ..... 267/100
2,272,807 A * 2/1942 Kronheim ..... 267/99
3,080,576 A 3/1963 Cervisi
3,945,627 A 3/1976 Simon
3,992,732 A 11/1976 Cervisi
4,083,069 A 4/1978 Glickman
4,236,262 A 12/1980 Spiller
4,519,107 A 5/1985 Dillon et al.
4,685,162 A 8/1987 Higgins et al.
4,819,920 A * 4/1989 Barber ..... 267/90
5,319,815 A 6/1994 Stumpf et al.
7,748,066 B2 7/2010 Gladney

* cited by examiner

*Primary Examiner* — Robert G Santos

(74) *Attorney, Agent, or Firm* — The Livingston Firm; Edward M. Livingston, Esq.; Bryan L. Loeffler, Esq.

(57) ABSTRACT

A box spring (9) having a rigid perimeter wall (16) to provide a firm foundation to support an edge of a mattress (1) where individuals normally sit. A layer of coil springs (20) rests on a center portion (2) of the box spring and extends above the rigid perimeter wall to provide active support to a center portion of the mattress where individuals normally lie.

4 Claims, 3 Drawing Sheets

BOX SPRING SUPPORT FOR MATTRESSES

FIELD OF THE INVENTION

This invention relates to mattresses, more particularly, a framed box spring having a raised layer of coil springs surrounded by a frame that provides rigid support to the edges of a mattress while the raised coil springs provide an active support for the center portion of the mattress.

BACKGROUND OF THE INVENTION

A box spring is the part of a bed that provides a foundation for and supports the mattress. The box-spring is usually the same size as the mattress which is placed above the box-spring. Conventional box springs are typically made of a frame covered in cloth that provides a hard foundation. Alternatively, box springs may have a frame having an upper layer of springs attached thereto. The purpose of the box spring is to reduce wear on the mattress by absorbing shock and to create a flat and firm structure for the mattress to lie upon. However, with conventional box springs only one of these two objectives may be met depending on the structure of the box spring. For example, a conventional box spring made solely of a frame provides a flat firm structure but does not absorb shock. Alternatively, a box spring having a frame with an upper layer of springs absorbs shock but does not provide a firm foundation for the outer perimeter of the mattress. Having a firm outer perimeter is important to provide support to individuals sitting on the edge of the mattress.

Therefore, a need exists for a box spring that provides a firm foundation for supporting the perimeter of a mattress while also providing an active foundation to support the center portion of a mattress.

The relevant prior art includes the following references:

| Pat. No. (U.S. Patent References) | Inventor | Issue/Publication Date |
|---|---|---|
| 3,080,576 | Cervisi | Mar. 12, 1963 |
| 3,945,627 | Simon | Mar. 23, 1976 |
| 3,992,732 | Cervisi | Nov. 23, 1976 |
| 4,083,069 | Glickman | Apr. 11, 1978 |
| 4,236,262 | Spiller | Dec. 02, 1980 |
| 4,519,107 | Dillon et al. | May 28, 1985 |
| 4,685,162 | Higgins et al. | Aug. 11, 1987 |
| 5,319,815 | Stumpf et al. | Jun. 14, 1994 |
| 7,748,066 | Gladney | Jul. 06, 2010 |

SUMMARY OF THE INVENTION

The primary object of the present invention is to provide a box spring that provides a film foundation for supporting the perimeter of a mattress while also providing an active foundation to support the center portion of a mattress.

The present invention fulfills the above and other objects by providing a box spring having a framed edge to provide a firm foundation to support a perimeter edge of a mattress. The framed edge is rigid, thereby allowing firm support of a semi-rigid perimeter of a mattress. This support is needed to support the perimeter edge of the mattress which individuals sit on in an upright position and expect firmer support. A layer of coil springs rests on a base and extends a predetermined distance above the framed edge to provide active support and shock absorption to a center portion of the mattress on which individuals lay and expect to be softer than the outer edge of the mattress.

An alternative embodiment of the invention replaces the layer of coil springs with a one or more layers of foam that extends a predetermined distance above the framed edge of the box spring.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
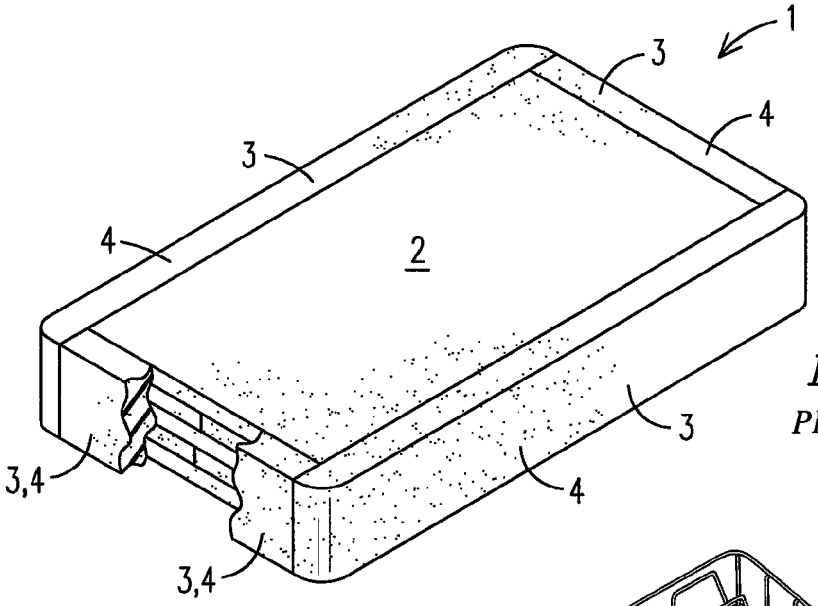
FIG. 1 PRIOR ART
FIG. 1 is a top perspective partial cutaway view of a conventional mattress.

For purposes of describing the preferred embodiment, the terminology used in reference to the numbered accessories in the drawings is as follows:

1. conventional mattress
2. center portion of mattress
3. perimeter encasement
4. foam panels
5. conventional box spring
6. conventional frame
7. upper layer of coil springs
8. upper surface of conventional frame
9. box spring of the present invention
10. frame
11. lower portion of frame
12. upper portion of frame
13. rectangular perimeter
14. cross support
15. vertical support
16. perimeter wall
17. upper edge of perimeter wall
18. lower edge of perimeter wall
19. panel
20. spring
21. upper protective layer
22. raised center portion of box spring With reference to FIG. 1, a top perspective partial cutaway view of a conventional mattress is illustrated as an example of the prior art. The conventional mattress 1 comprises a core center portion 2 made up of various layers of foam to create the main body of the mattress 1. The mattress may also have a center portion 2 comprising coil springs or a combination of springs and foam. The core 2 is surrounded and framed by a foam perimeter encasement 3 around the perimeter edge that is constructed out of foam panels 4 having a height equal to that of the center portion 2. By using a foam encasement 3, the center portion 2 is prevented from spreading outward when an individual is lying on the mattress 1. In addition, the encasement 3 provides a more rigid support for individuals sitting on the edge of the mattress.

Figure 2:
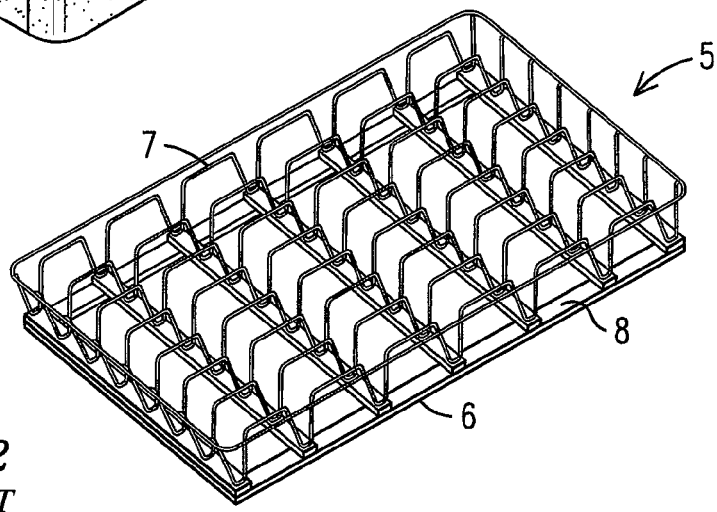
FIG. 2 PRIOR ART
FIG. 2 is a top perspective view of an uncovered conventional box spring having a conventional frame supporting an upper layer of springs.

With reference to FIG. 2, a top perspective view of an uncovered conventional box spring 5 having a conventional frame 6 supporting an upper layer of springs 7 is illustrated as an example of the prior art. The upper layer of springs 7 extends across the entire upper surface 8 of the conventional frame 6, thereby providing no rigid support to the perimeter encasement 3 of the mattress (as illustrated in FIG. 1). As illustrated, the upper layer of springs 7 are substantially U-shaped springs but may also be coil springs.

Figure 3:
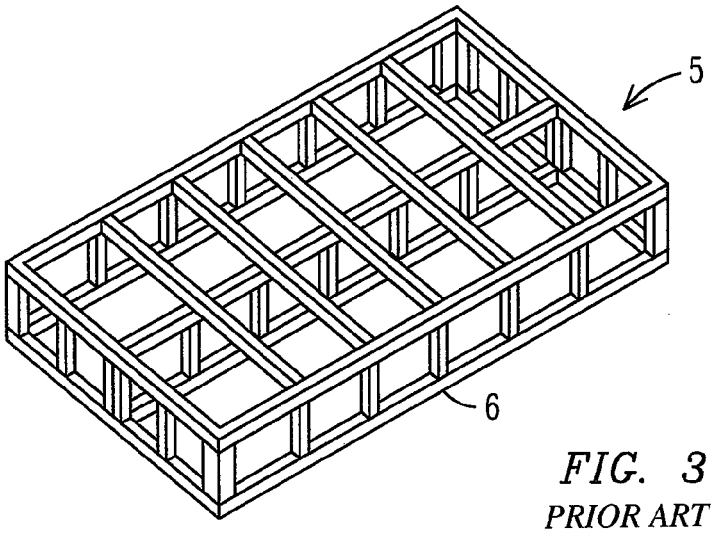
FIG. 3 PRIOR ART
FIG. 3 is a top perspective view of an uncovered conventional box spring having only a conventional frame and no springs.

With reference to FIG. 3, a top perspective view of an uncovered conventional box spring 5 having only a conventional frame 6 and no springs 7 is illustrated as an example of the prior art. The conventional frame 6 only provides only rigid support, thereby failing to provide and active support or shock absorption to center portion 2 the mattress 1 (as illustrated in FIG. 1).

Figure 4:
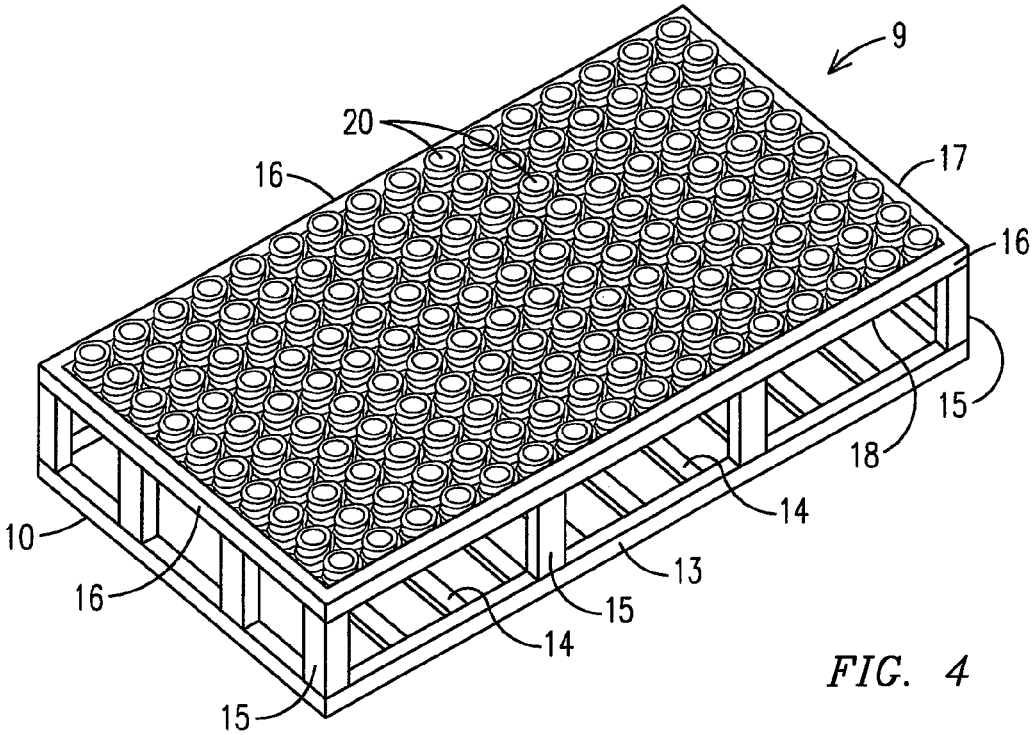
FIG. 4 is a top perspective view of an uncovered box spring of the present invention.
Figure 5:
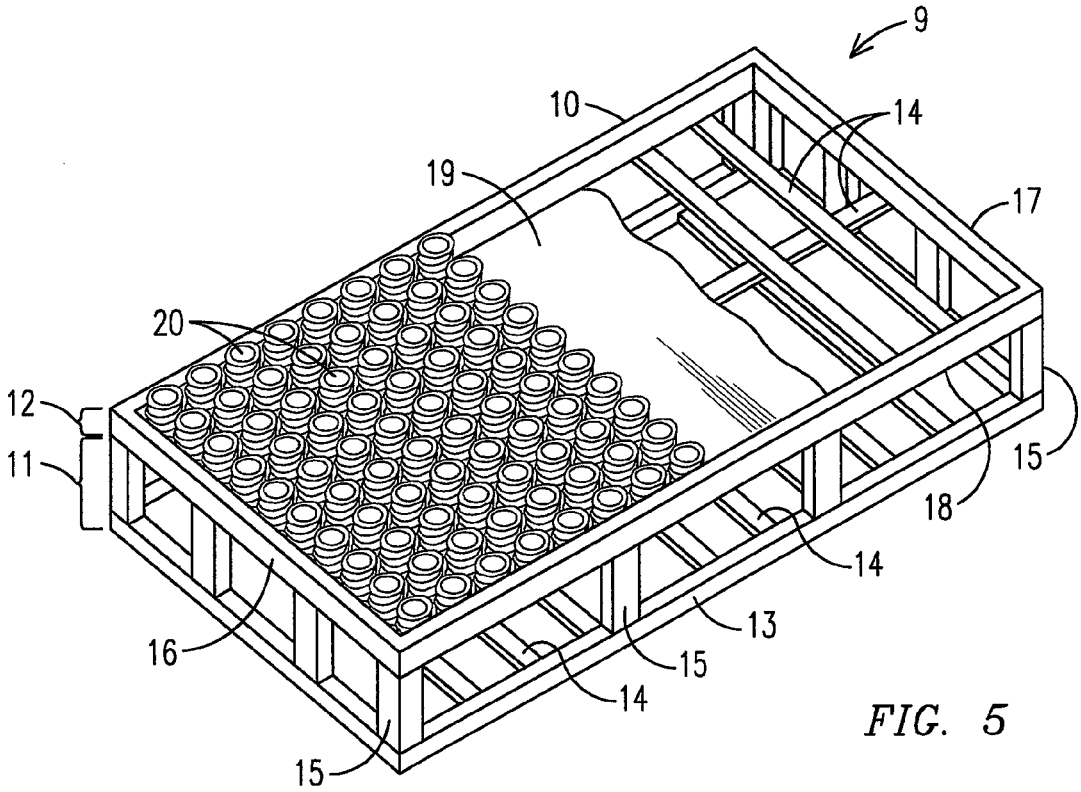
FIG. 5 is a top perspective partial cutaway view of an uncovered box spring of the present invention.
Figure 6:
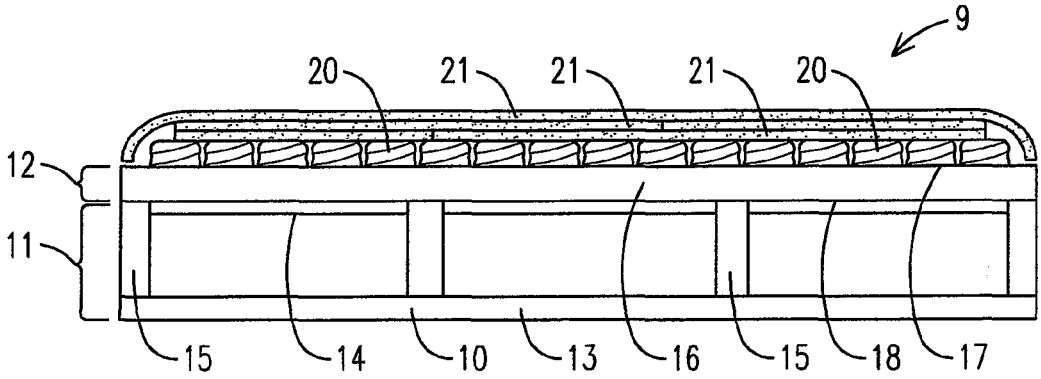
FIG. 6 is a side view of an uncovered box spring of the present invention.

With reference to FIGS. 4, 5 and 6, a top perspective view of an uncovered box spring 9 of the present invention and a top perspective partial cutaway view of an uncovered box spring 9 of the present invention and a side view of an uncovered box 9 spring of the present invention, respectively, are illustrated. The box spring 9 comprises a frame 10 having a lower portion 11 and an upper portion 12. The lower portion 11 comprises an outer rectangular perimeter 13 having torsion bars or cross supports 14 located between the rectangular perimeter 13. Vertical supports 15 extend upward from the rectangular perimeter 13 to support the upper portion 12 of the wood frame 10. The upper portion 12 comprises a rectangular shaped perimeter wall 16 having an upper edge 17 and a lower edge 18. Cross supports 14 extend between the perimeter wall 16 proximal to the lower edge 18 to create a support for a panel 19, which may be a rigid material or a fabric material, that provides further support for springs 20 located within the perimeter wall 16 above the panel 19. The coil springs 20 preferably have a height that is greater than the perimeter wall 16 so the coil springs 20 extend above the upper edge 17 of the perimeter wall 16. Although not illustrated here, a foam core comprising one or more layers of foam may be located within the perimeter wall 16 and have a height that is greater than the height of the perimeter wall. The foam core may be separate or in addition to one or more layers of coil springs 20. As illustrated in FIG. 6, the coil springs 20 extend above the upper edge 17 of the perimeter wall 16 and are covered by one or more upper protective layers 21 to provide additional active support for the mattress 1. The one or more upper protective layers 21 may be foam, fiber, cloth and so forth.

Figure 7:
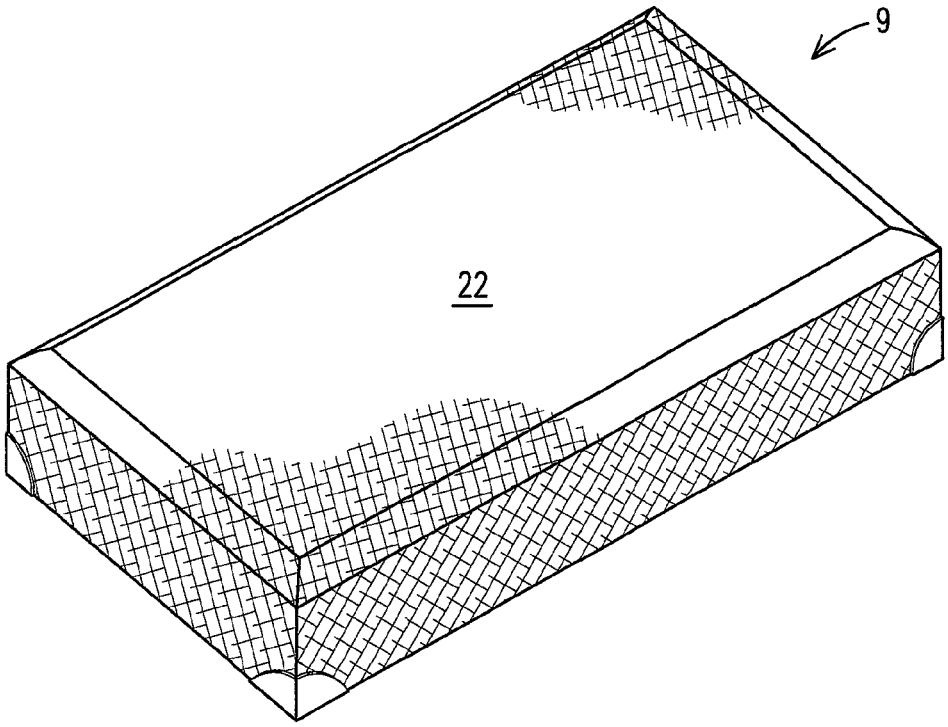
FIG. 7 is a top perspective view of a covered box spring of the present invention.

With reference to FIG. 7, a top perspective view of a covered box spring 9 of the present invention is illustrated. The box spring 9 has been covered in fabric 22. The coil springs 20 that extend above the perimeter wall 16, as illustrated in previous figures, create a raised center portion 22 on the box spring 9 that provides an active support to the center portion 2 of a mattress 1 while the perimeter wall 16 of the frame 10 provides a rigid foundation to support the perimeter encasement 3 of the mattress.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

We claim:

1. A box spring comprising:

a lower portion for providing rigid support to an upper portion;

said lower portion having a rectangular perimeter with a plurality of cross supports located within the rectangular perimeter;

a plurality of vertical supports extending upward from the rectangular perimeter of the lower portion to a perimeter wall of the upper portion;

said perimeter wall having a lower surface that rests on the plurality of vertical supports;

said perimeter wall having an upper surface on which an outer perimeter of a mattress rests;

a plurality of cross supports located within the perimeter wall proximal to the lower surface of the perimeter wall and extending above said lower portion, thereby creating a support structure for a panel that rests on top of the plurality of the cross supports located within the perimeter wall;

a plurality of springs located within the perimeter wall and on top of the panel superior to the lower portion of the box spring;

said plurality of springs each having heights that are greater than the height of the perimeter wall so the plurality of springs extend above the upper surface of the perimeter wall, thereby creating a raised center portion; and said box spring being covered in cloth.

2. The box spring of claim 1 wherein:

the panel is a made of a rigid material.

3. The box spring of claim 1 wherein:

the panel is a made of a fabric.

4. The box spring of claim 1 further comprising:

at least one upper protective layer located above the plurality of springs.

* * * * *